US007705539B2

(12) United States Patent
Wen

(10) Patent No.: US 7,705,539 B2
(45) Date of Patent: Apr. 27, 2010

(54) TUNGSTEN-HALOGEN QUARTZ LAMP

(76) Inventor: Debiao Wen, 1503, No. 43, Jihua 5 Road, Chancheng District, Foshan City, Guangdong Province, 528000 (CN)

( * ) Notice: Subject to any disclaimer, the term of this patent is extended or adjusted under 35 U.S.C. 154(b) by 105 days.

(21) Appl. No.: 11/918,083

(22) PCT Filed: Aug. 17, 2006

(86) PCT No.: PCT/CN2006/002098

§ 371 (c)(1),
(2), (4) Date: Oct. 9, 2007

(87) PCT Pub. No.: WO2007/025458

PCT Pub. Date: Mar. 8, 2007

(65) Prior Publication Data

US 2009/0085481 A1 Apr. 2, 2009

(30) Foreign Application Priority Data

Aug. 29, 2005 (CN) ..... 2005 2 0063784 U

(51) Int. Cl.
*H01J 61/30* (2006.01)

(52) U.S. Cl. ..... 313/634

(58) Field of Classification Search ..... 313/634, 313/274

See application file for complete search history.

(56) References Cited

U.S. PATENT DOCUMENTS 3,875,443 A * 4/1975 Nakamura ..... 313/274
5,821,678 A 10/1998 Michel

FOREIGN PATENT DOCUMENTS

| | | |
|---|---|---|
| CN | 2609177 Y | 3/2004 |
| CN | 2626047 Y | 7/2004 |
| CN | 2720619 Y | 8/2005 |
| GB | 1 443 542 | 7/1976 |

OTHER PUBLICATIONS

English translation of CN 2609177 Y (Mar. 2004).*

* cited by examiner

*Primary Examiner*—Joseph L Williams
*Assistant Examiner*—Hana A Sanei
(74) *Attorney, Agent, or Firm*—Frommer Lawrence & Haug LLP; Ronald R Santucci

(57) ABSTRACT

A tungsten-halogen quartz lamp with a structure for preventing glass-bead supporter from breaking off, which can insure that its glass-bead supporter could not leave and drop from the top of a bulb in any case, so that reliability of a holding-filament structure is greatly improved and the service life of the lamp is prolonged. For this purpose, a concave-baking ring is provided at the circumference of the bulb, which corresponds to a position below the glass-bead supporter which is mounted in the upper of inner-cavity of the bulb in a horizontal direction, to restrict the glass-bead supporter to the upper of the bulb.

3 Claims, 2 Drawing Sheets

TUNGSTEN-HALOGEN QUARTZ LAMP

This application is a 371 of PCT/CN2006/002098 filed on Aug. 17, 2006, published on Mar. 8, 2007 under publication No. WO 2007/025458 A1 which claims priority benefits from Chinese Patent Application Ser. No. 200520063784.9 filed Aug. 29, 2005, the disclosure of which is hereby incorporated by reference.

FIELD OF THE INVENTION

The present invention relates to a tungsten-halogen quartz lamp, and more particularly to a tungsten-halogen quartz lamp with a structure for preventing a glass supporting bar of the tungsten-halogen quartz lamp from falling down.

BACKGROUND OF THE INVENTION

Generally, a tungsten-halogen quartz lamp is mainly composed of a lamp housing, a glass supporting bar, a filament, molybdenum foils and terminals. In some kinds of tungsten-halogen quartz lamps, the glass supporting bar is horizontally disposed in an upper portion of the lamp housing, and the filament is stretched between the glass supporting bar at an upper portion of the lamp housing and two molybdenum foils at a lower portion of the lamp housing. For the tungsten-halogen quartz lamp with such a structure, in order to elongate a service life of the tungsten-halogen quartz lamp, it is crucial to prevent the glass supporting bar from falling down and ensure a secure fixation of the glass supporting bar on the upper portion of the lamp housing. A conventional manner for fixing the glass supporting bar to the upper portion of the lamp housing is to form two small concaves on the lamp housing at the positions slightly below both ends of the glass supporting bar respectively. In a normal condition, the two small concaves may support the glass supporting bar and fix the same on the lamp housing. However, when the tungsten-halogen quartz lamp suffers continuous jolts, vibrations or impacts during a transportation or storage period, or during a working period, the glass supporting bar may be displaced away and falls down from the small concaves. As a result, the filament may form a short circuit and the lamp may be damaged.

SUMMARY OF THE INVENTION

The present invention aims to provide a tungsten-halogen quartz lamp with a glass supporting bar disposed at an upper portion of the lamp housing, in which the glass supporting bar will not fall down from the upper portion of the lamp housing, and thus a service life of the tungsten-halogen quartz lamp may be elongated.

According to an aspect of the present invention, there is provided a tungsten-halogen quartz lamp including a lamp housing, a filament, a glass supporting bar, molybdenum foils and terminals, the molybdenum foils being connected to the terminals respectively, the glass supporting bar being mounted at an upper portion of the lamp housing, the filament being stretched between the glass supporting bar and the molybdenum foils, wherein a ring-shaped concave is formed on the lamp housing at a position below the glass supporting bar so as to confine the glass supporting bar within the upper portion of the lamp housing. The ring-shaped concave is preferably arranged to be adjacent to a bottom of the glass supporting bar. Also, the ring-shaped concave is arranged horizontally. The above ring-shaped concave may well perform the function of supporting the glass supporting bar.

Compared with the conventional tungsten-halogen quartz lamp, the present invention may obtain a prominent technical effect.

Particularly, due to the ring-shaped concave formed on the lamp housing at a position slightly below the glass supporting bar, the upper portion of the lamp housing is formed in a shape of a gourd and thus the glass supporting bar may be firmly supported. Thus, even when the tungsten-halogen quartz lamp is disadvantageously loose or displaced when the lamp suffers continuous jolts, vibrations and impacts during being transported or stored, the glass supporting bar will not fall down from the upper portion of the lamp housing. In other words, a tungsten-halogen quartz lamp according to the present invention may ensure a normal service life of the filament, and the failures such as a short circuit of the filament due to falling down of the glass supporting bar will not occur. Therefore, the reliability as well as the service life of the tungsten-halogen quartz lamp may be greatly improved due to the structure according to the present invention.

DETAILED DESCRIPTION OF THE INVENTION

Hereinafter, the present invention will be described in details with reference to an embodiment.

Figure 1:
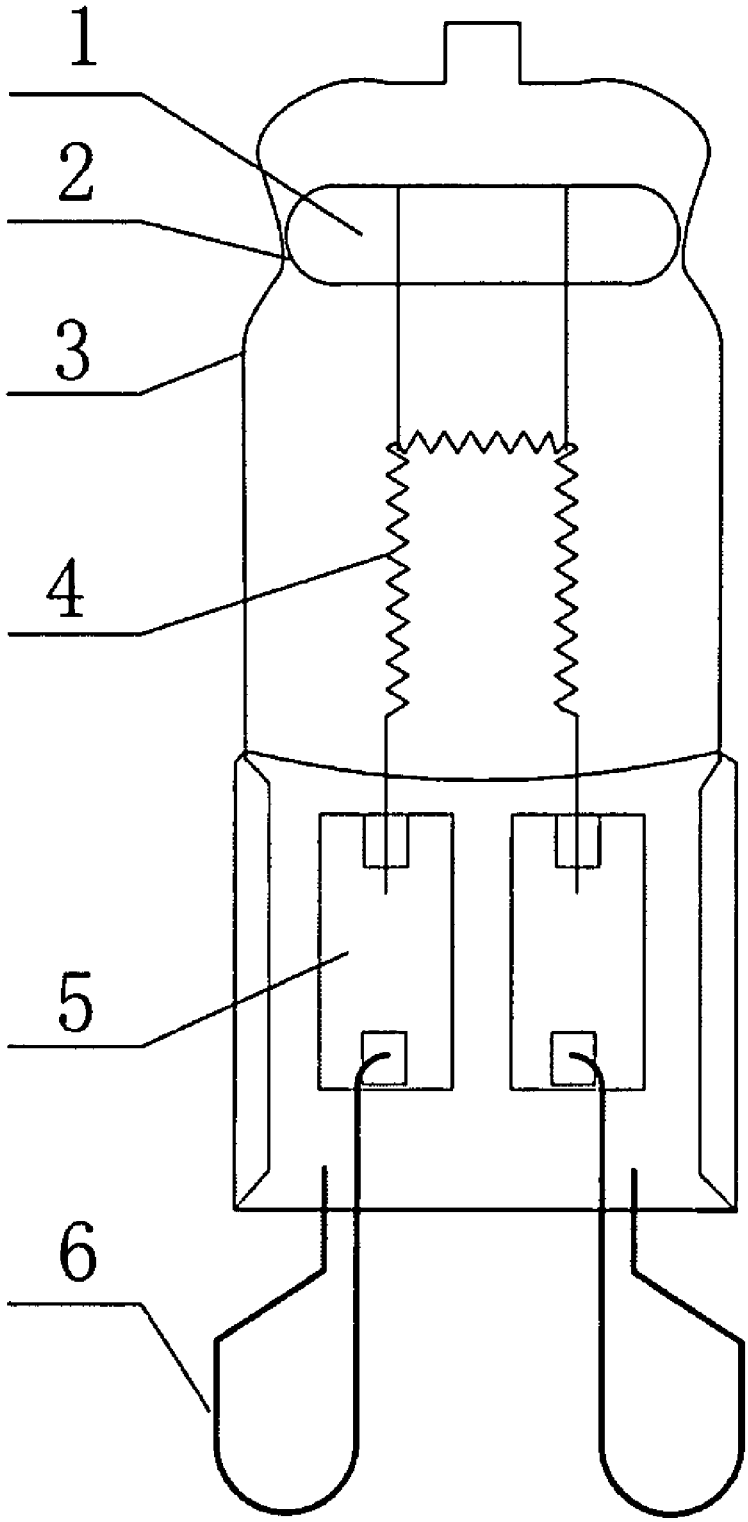
FIG. 1 is a structural diagram view showing a tungsten-halogen quartz lamp with a structure for preventing a glass supporting bar from falling down according to an exemplary embodiment of the present invention.
Figure 2:
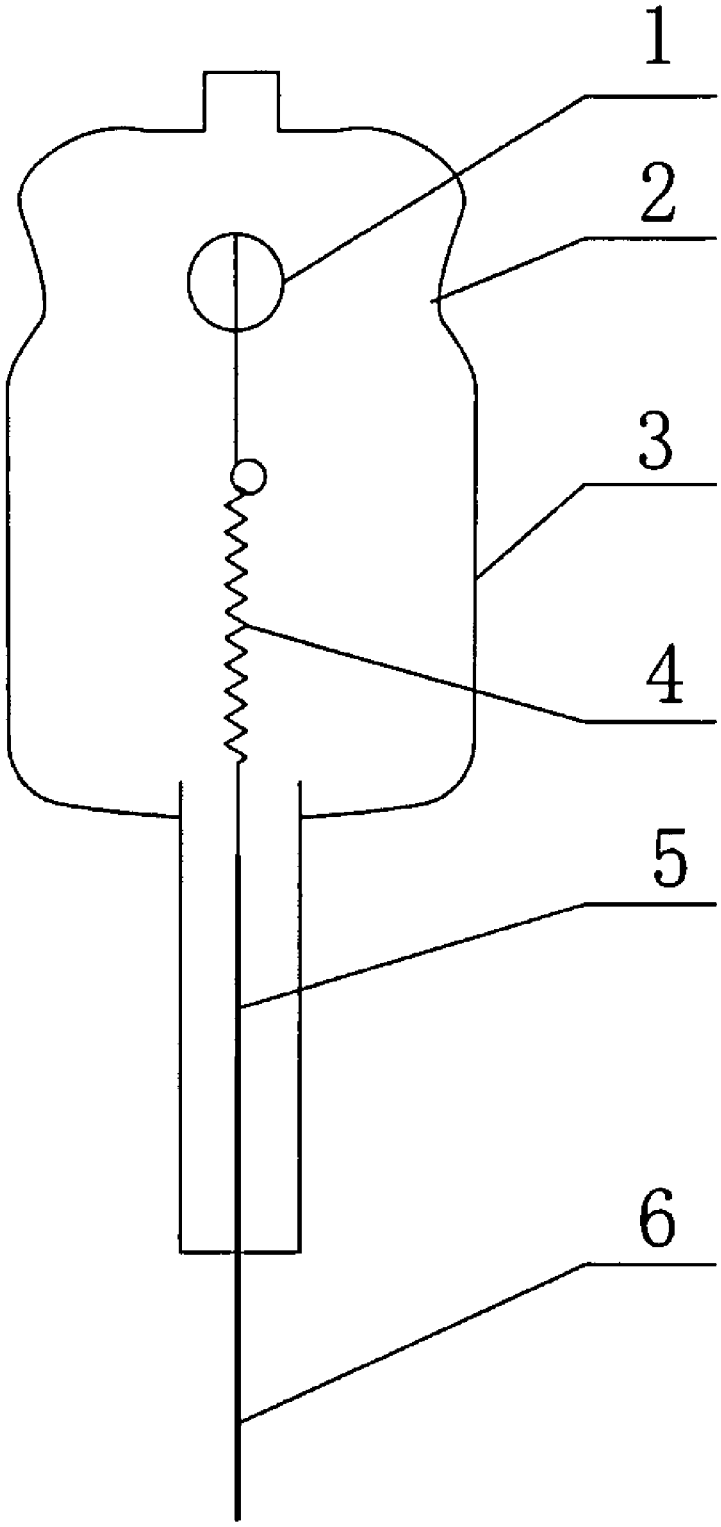
FIG. 2 is a side view of the tungsten-halogen quartz lamp shown in FIG. 1.

As shown in FIGS. 1 and 2, a tungsten-halogen quartz lamp according to the present invention with a structure for preventing a glass supporting bar from falling down includes a glass supporting bar 1, a ring-shaped concave 2, a lamp housing 3, a filament 4, two molybdenum foils 5 and two terminals 6. The glass supporting bar 1 is horizontally mounted at an upper portion of a cavity defined by the lamp housing 3. The two molybdenum foils 5 are arranged at a lower portion of the lamp housing 3 and are connected to the two terminals 6 respectively. The filament 4 is stretched between the two molybdenum foils 5 and the glass supporting bar 1. The ring-shaped concave 2 is formed on the lamp housing 3 at a position slightly below the glass supporting bar 1, by a baking process for example. Preferably, the ring-shaped concave 2 is arranged horizontally. In this way, the upper portion of the lamp housing has a shape of a gourd. Thus, the glass supporting bar 1 is firmly supported over the ring-shaped concave 2. Such a structure ensures that the glass supporting bar 1 will not fall down from the upper portion of the lamp housing, even when the glass supporting bar 1 is undesirably loose or is displaced away from its original position. Thus, any circumstance which may shorten the service life of the tungsten-halogen quartz lamp such as a short circuit and the failure of the filament may be avoided.

What is claimed is:

1. A tungsten-halogen quartz lamp including a lamp housing, a filament, a glass supporting bar, molybdenum foils and terminals, the molybdenum foils being connected to the terminals respectively, the glass supporting bar being mounted at an upper portion of the lamp housing, the filament being stretched between the glass supporting bar and the molybdenum foils, wherein a ring-shaped concave is formed on the lamp housing at a position below the glass supporting bar so as to confine the glass supporting bar within the upper portion of the lamp housing.

2. The tungsten-halogen quartz lamp as set forth in claim 1, wherein the ring-shaped concave is arranged to be adjacent to a bottom of the glass supporting bar.

3. The tungsten-halogen quartz lamp as set forth in claim 1, wherein the ring-shaped concave is arranged horizontally.

* * * * *